United States Patent [19]

Laros et al.

[11] 4,377,473

[45] Mar. 22, 1983

[54] METHOD FOR CONCENTRATING THE EXINITE GROUP MACERALS FROM COAL BY FROTH FLOTATION

[75] Inventors: Timothy J. Laros, Price, Utah; Richard D. Pick, Englewood, Colo.

[73] Assignee: Atlantic Richfield Company, Los Angeles, Calif.

[21] Appl. No.: 283,755

[22] Filed: Jul. 16, 1981

[51] Int. Cl.[3] ..... B03D 1/14

[52] U.S. Cl. ..... 209/167; 209/166; 209/9; 252/61; 210/704; 210/705

[58] Field of Search ..... 209/166, 167, 9; 252/61; 210/703, 704, 705

[56] References Cited

U.S. PATENT DOCUMENTS

| | | | |
|---|---|---|---|
| 1,773,997 | 8/1930 | Green et al. | 209/167 |
| 2,319,394 | 5/1943 | Erickson | 209/166 |
| 2,330,479 | 9/1943 | Erickson | 209/166 |
| 2,506,301 | 5/1950 | Klepetko et al. | 209/166 |
| 2,591,830 | 4/1952 | Klepetko et al. | 209/166 |
| 3,696,923 | 10/1972 | Miller | 209/166 |
| 3,710,939 | 1/1973 | Hostynek et al. | 209/166 |
| 4,162,966 | 7/1979 | Finch | 209/166 |
| 4,272,364 | 6/1981 | Dixon et al. | 209/166 |

*Primary Examiner*—Norman Yudkoff

*Attorney, Agent, or Firm*—F. Lindsey Scott

[57] ABSTRACT

A method for separating the exinite group macerals from the total coal by froth flotation in the presence of at least one short chain alcohol frothing agent and at least one methyl polyglycol type frothing agent in a first froth flotation zone to produce an exinite and other coal maceral-rich stream which is thereafter subjected to froth flotation in a second froth flotation zone in the presence of a short chain alcohol frothing agent to produce an exinite group maceral-rich stream and a stream rich in other coal macerals with the exinite-rich stream thereafter being mixed with an additional quantity of a short chain alcohol frothing agent and passed to a third froth flotation zone to produce an exinite group maceral group concentrate stream which is thereafter processed to produce a particulate exinite maceral group concentrate.

9 Claims, 1 Drawing Figure

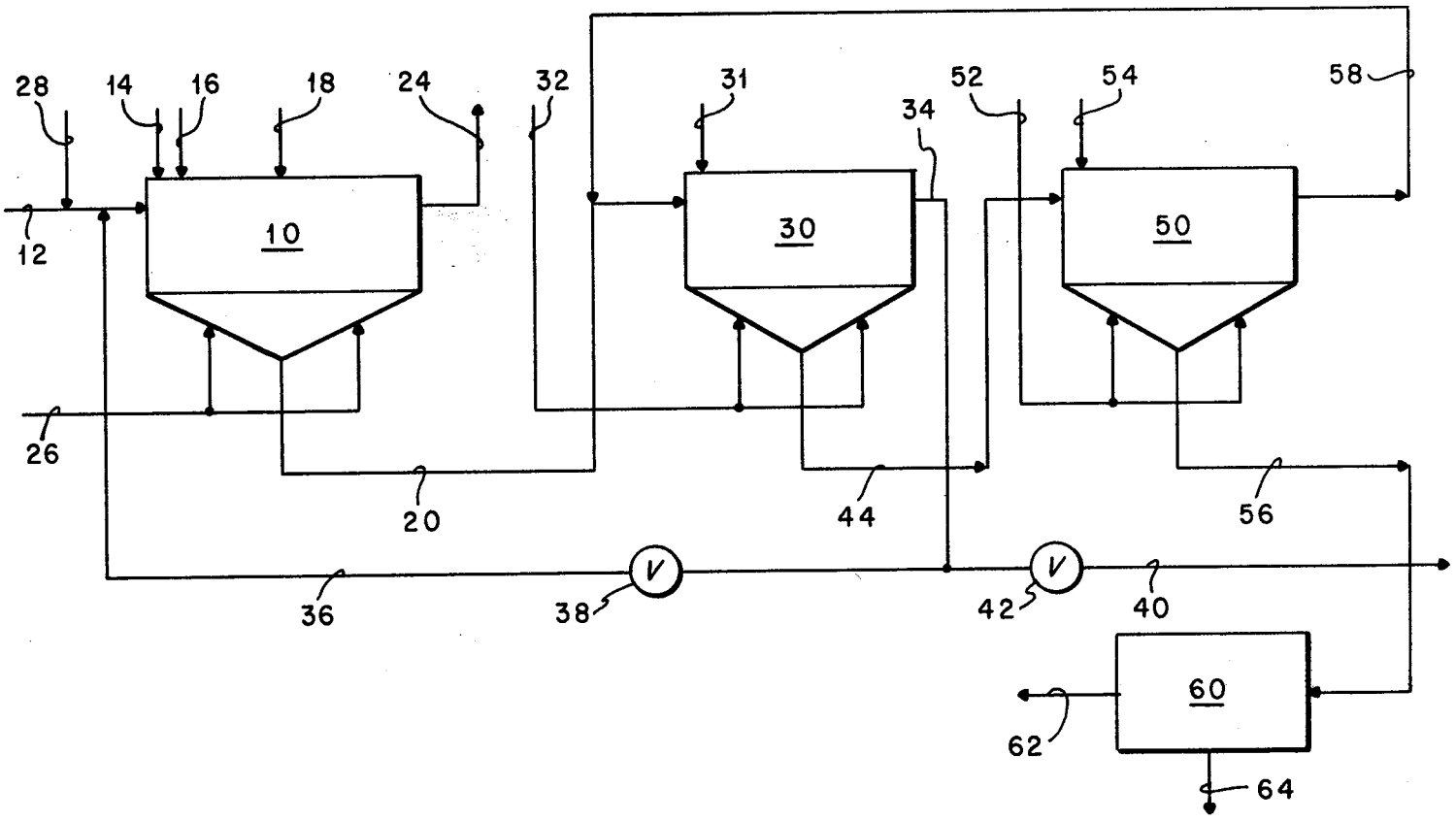
58
50
54
52
56
34
30
31
44
32
24
10
18
16
14
28
12
26
20
36
38
V
40
42
V
60
64
62

METHOD FOR CONCENTRATING THE EXINITE GROUP MACERALS FROM COAL BY FROTH FLOTATION

This invention relates to the production of a concentrate of the exinite group macerals from the total coal.

This invention further relates to the production of fossil resin concentrates from aqueous slurries containing coal, fossil resin, and inorganic solids.

In certain coal deposits, the coal matrix contains relatively high proportions of exinite group macerals, i.e., on the order of five percent. Some such coal deposits are located in Utah. The locations of these deposits and the value of the resinous materials (exinite group macerals) contained in the deposits have been well known for many years, and various efforts have been made to recover such resinous materials. Nearly all coals contain at least trace quantities of such resinous material, but it is only in those coals which contain relatively high quantities of the resinous materials that the recovery of the resinous material is practical.

As known to those skilled in the art, coal is comprised of macerals. These materials have been classified as follows:

| GROUP MACERAL | MACERAL | SUBMACERAL | MACERAL VARIETY |
|---|---|---|---|
| Vitrinite | Telinite | Telinite 1 | Cordaitotelinite |
| | | Telinite 2 | Fungotelinite |
| | | | Xylotelinite |
| | | Telocollinite | Lepidophytotelinite |
| | | Gelocollinite | Sigillariotelinite |
| | Collinite | Desmocollinite | |
| | | Corpocollinite | |
| | Vitrodetrinite | | |
| Exinite | Sporinite | | Tenuisporinite |
| | | | Crassisporinite |
| | | | Microsporinite |
| | | | Macrosporinite |
| | Cutinite | | |
| | Resinite | | |
| | Alginite | | Pila-Alginite |
| | | | Reinschia-Alginite |
| | Liptodetrinite | | |
| Inertinite | Micrinite | | |
| | Macrinite | | |
| | Semifusinite | | |
| | Fusinite | Pyrofusinite | |
| | | Degradofusinite | |
| | Sclerotinite | Fungosclerotinite | Plectenchyminite |
| | | | Corposclerotinite |
| | | | Pseudo-corposclerotinite |
| | Inertodetrinite | | |

Stach's Textbook of Coal Petrology, edited by Stach et al., Gebrueder Borntraeger, Berlin, West Germany, 1975, pp. 58.

The materials referred to as fossil resins or resins herein are that portion of the coal matrix known as the exinite group macerals. Resinite is the most frequently occurring exinite maceral in American coals. Such resinous materials are soluble in solvents such as hexane, toluene, benzene and the like.

The occurrence of such fossil resins in American coals, particularly those in Utah, has been known for some time and various methods have been used in attempts to recover fossil resins from such coals as discussed in the following references which were considered in the preparation of the present application.

"An American Source of Natural Resins for the Paint and Varnish Industry", Adriaan Nagelvoort, *Chemical*

*and Metallergical Engineering,* October, 1942, Vol. 49, pp. 80–82.

"Recovery of Resin from Utah Coal", Ernest Klepetko, American Institute of Mining and Metallurgical Engineers, Technical Publication No. 2166, May 1947.

*Stach's Textbook of Coal Petrology,* Edited by Stach et al., Gebrueder Borntraeger, Berlin, West Germany 1975, pp. 58–95.

U.S. Pat. No. 1,773,997

U.S. Pat. No. 2,378,152

These references are illustrative of the state of the art and are hereby incorporated in their entirety by reference.

While various methods for recovering such fossil resins have been proposed and, in some instances, practiced, none of the methods have been completely satisfactory for a variety of reasons. Some of the methods require that the coal be crushed to a particular size or use relatively expensive organic solvents. Others use coal depressants, such as guar gums, starches, etc., in froth flotation processes to inhibit clay and coal flotation, and the like. None of these processes, to Applicant's knowledge, is in commercial application today. Accordingly, it is highly desirable that an improved method be available for the recovery of such fossil resins since there is a substantial demand for the fossil resins.

It has now been found that such resins can be recovered from an aqueous slurry containing liberated fossil resin solids, finely divided coal solids, and finely divided inorganic solids by a process which consists essentially of:

(a) adjusting the concentration of said slurry to from about 3 to about 15 weight percent solids;

(b) admixing from about 25 to about 50 mg of a first froth flotation agent selected from the group consisting of short chain alcohol frothing agents containing from about 6 to 8 carbon atoms and from about 2 to about 10 mg of a second froth flotation agent selected from the group consisting of polyglycol-type frothers per kilogram of said solids in said slurry with said slurry to produce a mixture;

(c) admixing an additional quantity of from about 25 to about 50 mg of said first froth flotation agent per kilogram of solids in said slurry with said mixture in a first froth flotation zone at an average residence time from about 3 to about 6 minutes after charging said mixture to said first froth flotation zone;

(d) subjecting said mixture to froth flotation in said first froth flotation zone for a total average residence time from about 8 to about 10 minutes to produce a resin and coal-rich stream and an inorganic solids rich stream;

(e) admixing up to about 5 mg of said first froth flotation agent per kilogram of said solids in said slurry with said resin and coal-rich stream to produce a second mixture;

(f) subjecting said second mixture to froth flotation in a second froth flotation zone for an average residence time from about 3 to about 6 minutes to produce a resin-rich stream and a first coal-rich stream;

(g) admixing up to 5 mg of said first froth flotation agent per kilogram of said solids in said slurry with said resin-rich stream to produce a third mixture;

(h) subjecting said third mixture to froth flotation in a third froth flotation zone for an average residence time from about 1 to about 4 minutes to produce a resin concentrate stream and a second coal-rich stream;

(i) recycling said second coal-rich stream to said second froth flotation zone; and (j) producing a particulate resin concentrate from said resin concentrate stream.

FIG. 1 is a schematic diagram of an embodiment of the process of the present invention.

In FIG. 1, a froth flotation vessel 10 is shown. Froth flotation vessel 10 may be a standard froth flotation vessel suitable for separating coal and inorganic materials. An aqueous stream containing liberated resin, finely divided coal and finely divided inorganic solids is charged to vessel 10 through a line 12. A first quantity (from about 25 to about 50 mg per kilogram of solids in the slurry in line 12) of a first froth flotation agent, selected from the group consisting of short chain alcohol frothing agents containing from about 6 to about 8 carbon atoms is charged to vessel 10 through a line 14. At least one second froth flotation agent selected from the group consisting of polyglycol-type frothers is charged to vessel 10 through a line 16 in an amount equal to from about 2 to about 10 mg per kilogram of solids in the slurry in line 12. The concentration of solids in line 12 may be adjusted by concentrating the slurry, or by the addition of water through a line 28, as shown. Normally, no adjustment will be required to reach a solids concentration less than about 15 weight percent solids. Typical average residence times in vessel 10 are from about 8 to 10 minutes. In the practice of the present invention a second quantity of first frothing agent is added to the middle section of vessel 10 through a line 18. Desirably, the second quantity of first frothing agent is added at a point where the slurry has been in vessel 10 for an average residence time from about 3 to about 6 minutes. In vessel 10, the aqueous slurry is separated into a resin and coal-rich stream which is recovered through a line 20 and an inorganic solids-rich stream which is recovered through a line 24 and passed to discharge. Air is supplied to vessel 10 through a line 26 and distributed through a rotor assembly or the like as well known to those skilled in the art. No novelty is considered to reside in the particular type of froth flotation vessel used. The resin and coal-rich stream recovered through line 20 is passed to a second froth flotation vessel 30 where it is separated into a resin-rich stream recovered through a line 44 and a first coal-rich stream recovered through a line 34. An additional quantity of first froth flotation agent up to about 5 mg per kilogram of solids in line 12 is added to the stream charged to second vessel 30 through a line 31. The coal-rich stream recovered through line 34 may be passed through a valve 42 and a line 40 to use as a clean coal product or all or a portion of the coal stream recovered through line 34 may be passed through a valve 38 and a line 36 back to vessel 10. Such a recycle facilitates the recovery of increased quantities of resin from the coal feed. Air is supplied to vessel 30 through a line 32 as known to those skilled in the art. The resin-rich stream recovered through line 44 is passed to a third froth flotation vessel 50 where it is mixed with up to about 5 mg of first frothing agent (added through a line 54) per kilogram of solids in line 12, charged to vessel 50 and separated into a resin concentrate stream recovered through a line 56 and a second coal-rich stream recovered through a line 58. As shown in the Figure, the coal-rich stream in line 58 is desirably recycled to vessel 30. The resin concentrate stream recovered through line 56 is passed to a filter 60 where it is filtered to produce a resin concentrate typically containing more than about 50 weight percent resin which is recovered through a line 62 as a particulate product and water which is recovered through a line 64. The water recovered through line 64 may contain resin and may be recycled to filtration, filtered further or the like to recover additional resin if desired.

In the practice of the process of the present invention, aqueous slurries containing liberated fossil resin, finely divided coal and finely divided inorganic solids such as clays, gangues, and the like, are used as a feed stream to the process. Such streams are typically produced in normal coal cleaning operations when modern cleaning plants are used. Typically, the run of mine coal is crushed to a size in the range of 3 to 6 inches. The coal is then passed to cleaning to remove undesirable inorganic solids, clays and the like from the coal product. As a result of the cleaning process, an aqueous slurry containing finely divided liberated fossil resin, finely divided coal and finely divided inorganic solids is produced when coals containing substantial quantities of fossil resin are cleaned. As noted in U.S. Pat. No. 2,378,152, although a relatively small fraction of the coal is broken to a size passing through fine screens, such fine materials contain most of the resin present in the coal. This is primarily because the resin is relatively friable and, when exposed, as normally occurs upon breaking the coal along the resin-containing planes, substantial quantities of the resin are liberated from the larger coal particles during the cleaning process. As a result, a large portion of the total resin present in the coal initially is found in the aqueous slurry containing finely divided materials which, in many instances is discarded as a waste stream. By the process of the present invention, this stream, which is normally passed to waste, is processed to recover a valuable product, i.e., the resin. Further, the method of the present invention recovers a fine coal product as well.

In vessel 10, a first quantity from about 25 to about 50 mg of a first froth flotation agent, and from about 2 to about 10 mg of a second froth flotation agent per kilogram of solids in the slurry in line 12 are admixed with the slurry in line 12 to produce a feed mixture to froth flotation vessel 10. The proportions of the first froth flotation agent and the second froth flotation agent can be varied with the objective being the recovery of a major portion, i.e., greater than about 90 weight percent (dry basis) of the resin present without recovering excessive amounts of inorganic materials. A major portion of the coal will normally be recovered when desirable quantitites of resin are recovered.

While Applicant does not wish to be bound by any particular theory it is believed that the flotation agents added serve to create different types of froth upon aeration. Materials considered suitable as the first frothing agent are short chain alcohol frothing agents containing from about 6 to about 8 carbon atoms. Of these materials 4-methyl-2-pentanol (methyl isobutylcarbinol-MIBC) is preferred. The first froth flotation agent, i.e., 4-methyl-2-pentanol, when added in the quantities set forth above, produces a very brittle froth which has relatively little holding power for suspended solid materials. Materials considered suitable as the second frothing agent are selected from the group consisting of polyglycol-type frothers. Methyl glycol ether and polypropylene glycol methyl ether are preferred. The second froth flotation agent, i.e., the methyl glycol ether, polypropylene glycol methyl ether or mixtures thereof, when added in the quantities set forth above, produces relatively heavy tenacious foams which have substantial bearing power and will support relatively heavy solids in relatively high concentrations. Such froths are highly desirable for the recovery of coal. Some materials suitable as the second frothing agent are AERO FROTH 65[1] and DOW FROTH 250[2].

[1]Trademark of American Cynamid Company for polyglycol-type frother

[2]Trademark of Dow Chemical Company for polypropylene glycol methyl ether frother It has been found that a combination of at least one first froth flotation agent and at least one second froth flotation agent is necessary to achieve desirable recoveries of the resin from the aqueous slurry initially. It is desirable that a second quantity of from about 25 to about 50 mg of 4-methyl-2-pentanol per kilogram of solids in the slurry in line 12 be added to vessel 10 after an average residence time of from about 3 to about 6 minutes.

The coal and resin-rich stream recovered from vessel 10 through line 20 is then passed to a second froth flotation step in second vessel 30 where it is frothed with up to about 5 mg of 4-methyl-2-pentanol per kilogram of solids in line 12. The froth so produced tends to be somewhat more brittle than that found in first vessel 10 and, as a result, the resin tends to be floated away from the other coal constituents leaving a relatively clean coal stream. Optionally, the coal stream recovered from second vessel 30 may be recycled to the feed stream to first flotation vessel 10. Such a recycle tends to recover additional quantities of resin from the relatively clean coal recovered from second vessel 30.

In third flotation vessel 50, a third quantity of 4-methyl-2-pentanol typically up to about 5 mg per kilogram of solids in line 12 is added. This froth in third vessel 50 is a very brittle froth which serves to separate the resin selectively from the remaining coal in the feed stream. The coal in line 58 is a clean coal stream but it will usually contain substantial quantities of resin. This stream is desirably recycled to vessel 30. The resin concentrate stream recovered through line 56 typically contains in excess of 50 weight percent (dry basis) resin with the balance of the stream comprising coal and the like. In some instances, the resin content of the stream in line 56 may be as great as 75 weight percent (dry basis) resin. Clearly, a variety of arrangements are possible within the scope of the present invention and, in particular, a larger number of flotation vessels can be used in series with various recycle options being possible. The primary consideration in determining the number of froth flotation vessels to be used is the cost of recovering the resin concentrate. In most instances, it will be found necessary to use a solvent extraction step to purify the resin so the purity required for its ultimate use and, accordingly, increasing the purity of the concentrate beyond 50 to 75 weight percent (dry basis) by froth flotation is not economically attractive.

While the addition of a first quantity of from about 25 to about 50 mg of 4-methyl-2-pentanol, per kilogram of solids in the slurry in line 12 is suitable, a range from about 30 to about 35 mg per kilogram of such solids has been found desirable. Similarly, while from about 2 to about 10 mg of second froth flotation agent per kilogram of solids in the slurry in line 12 has been found suitable, a preferred range is from about 6 to about 8 mg per kilogram. While the addition of a second quantity of from about 25 to about 50 mg of 4-methyl-2-pentanol, per kilogram of solids in the slurry in line 12 has been found suitable, a preferred range is from about 30 to about 35 mg per kilogram.

While the addition of up to about 5 mg of 4-methyl-2-pentanol, to second vessel 30 per kilogram of solids in the slurry is considered suitable, usually at least 0.1 mg per kilogram of solids in the slurry in line 12 will be used, and a preferred range is from about 3 to about 5 mg per kilogram of solids in the slurry in line 12.

In the use of first froth flotation agent, 4-methyl-2-pentanol, in third vessel 50, at least 0.1 mg per kilogram of solids in the slurry in line 12 will usually be required, and quantities of from about 3 to about 5 mg per kilogram of solids in the slurry in line 12 have been found desirable.

While slurries up to about 15 weight percent solids are suitably treated by the process of the present invention, it is desirable that the slurry concentration be no more than about 10 weight percent solids and, preferably, the concentration is from about 5 to about 8 weight percent solids. The residence time in first flotation vessel 10 is typically from about 8 to about 10 minutes, although a preferred time is about 9 minutes. The second quantity of first froth flotation agent, 4-methyl-2-pentanol, can be added at a time from about 3 to about 6 minutes of average residence time in vessel 10, although it is preferred that the time be from about 4 to about 5 minutes.

As indicated previously, the froth flotation vessels can be of substantially any type known to those skilled in the art which are effective for the recovery of coal from aqueous slurries containing coal in combination with inorganic solids. Similarly, the recovery of resins from aqueous slurries containing resin, finely divided coal and inorganic materials is known to the art; however, by the process of the present invention, a particular combination of flotation agents has been discovered to be surprisingly effective in combination in the process described in the recovery of resin from coal containing such resins.

Having thus described the invention by reference to its preferred embodiments, it is respectfully pointed out that many variations and modifications are possible within the scope of the present invention. Many such variations and modifications may appear obvious and desirable to those skilled in the art upon a review of the foregoing description of preferred embodiments.

Having thus described the invention, I claim:

1. A method for separating coal and a resin concentrate from an aqueous slurry containing resin solids, finely divided coal solids and finely divided inorganic solids, said method consisting essentially of:

(a) adjusting the concentration of said slurry to from about 3 to about 15 weight percent solids;

(b) admixing from about 25 to about 50 mg of a first froth flotation agent selected from the group consisting of short chain alcohol frothing agents containing from about 6 to 8 carbon atoms and from about 2 to about 10 mg of a second froth flotation agent selected from the group consisting of polyglycol-type frothers per kilogram of said solids in said slurry with said slurry to produce a mixture;

(c) admixing an additional quantity of from about 25 to about 50 mg of said first froth flotation agent per kilogram of said solids in said slurry with said mixture in a first froth flotation zone at an average residence time from about 3 to about 6 minutes after charging said mixture to said first froth flotation zone;

(d) subjecting said mixture to froth flotation in said first froth flotation zone for a total average residence time from about 8 to about 10 minutes to produce a resin and coal-rich stream and an inorganic solids rich stream;

(e) admixing up to about 5 mg of said first froth flotation agent per kilogram of said solids in said slurry with said resin and coal-rich stream to produce a second mixture;

(f) subjecting said second mixture to froth flotation in a second froth flotation zone for an average residence time from about 3 to about 6 minutes to produce a resin-rich stream and a first coal-rich stream;

(g) admixing up to about 5 mg of said first froth flotation agent per kilogram of said solids in said slurry with said resin-rich stream to produce a third mixture;

(h) subjecting said third mixture to froth flotation in a third froth flotation zone for an average residence time from about 1 to about 4 minutes to produce a resin concentrate stream and a second coal-rich stream;

(i) recycling said second coal-rich stream to said second froth flotation zone; and (j) producing a particulate resin concentrate from said resin concentrate stream.

2. The method of claim 1 wherein said first froth flotation agent is 4-methyl-2-pentanol.

3. The method of claim 1 wherein at least a portion of said first coal-rich stream is recycled to said first froth flotation zone.

4. The method of claim 1 wherein said slurry concentration is adjusted to from about 5 to about 8 weight percent solids.

5. The method of claim 1 wherein said second froth flotation agent is methyl glycol ether or polypropylene glycol methyl ether.

6. The method of claim 1 wherein from about 30 to about 35 mg of 4-methyl-2-pentanol per kilogram of said solids in said slurry and from about 6 to about 8 mg of methyl glycol ether or polypropylene glycol methyl ether per kilogram of said solids are admixed with said slurry.

7. The method of claim 1 wherein said additional quantity of 4-methyl-2-pentanol is from about 30 to about 35 mg per kilogram of said solids in said slurry.

8. The method of claim 1 wherein an additional quantity from about 3 to about 5 mg 4-methyl-2-pentanol per kilogram of said solids in said slurry is admixed with said coal and resin-rich stream.

9. The method of claim 1 wherein from about 3 to about 5 mg 4-methyl-2-pentanol per kilogram of solids in said solids in said slurry is admixed with said resin-rich stream.

* * * * *